US005697983A

United States Patent [19]

Connell et al.

[11] Patent Number: 5,697,983

[45] Date of Patent: Dec. 16, 1997

[54] METHOD FOR THE TREATMENT OF WOOL

[75] Inventors: David Longley Connell; Kenneth Michael Huddlestone, both of Derby, England

[73] Assignee: Precision Processes Textiles, Derby, England

[21] Appl. No.: 983,593

[22] PCT Filed: Jun. 26, 1991

[86] PCT No.: PCT/GB91/01038

§ 371 Date: Feb. 4, 1993

§ 102(e) Date: Feb. 4, 1993

[87] PCT Pub. No.: WO92/00412

PCT Pub. Date: Jan. 9, 1992

[30] Foreign Application Priority Data

Jun. 26, 1990 [GB] United Kingdom ..... 9014192

[51] Int. Cl.[6] ..... D06M 11/50

[52] U.S. Cl. ..... 8/128.3; 8/128.1; 8/110; 8/111

[58] Field of Search ..... 8/128.1, 115.7, 8/115.69, 115.66, 110, 111, 128.3; 252/8.75, 8.8

[56] References Cited

U.S. PATENT DOCUMENTS

| | | | |
|---|---|---|---|
| 3,347,803 | 10/1967 | Frotscher | 252/8.8 |
| 3,476,502 | 11/1969 | Bill et al. | 8/128.3 |
| 4,255,311 | 3/1981 | Eldin et al. | 252/8.8 |
| 5,087,266 | 2/1992 | Connell et al. | 8/109 |

FOREIGN PATENT DOCUMENTS

| | | |
|---|---|---|
| 356950 | 3/1990 | European Pat. Off. . |
| 0356950 | 3/1990 | European Pat. Off. . |
| 1383496 | 11/1964 | France . |
| 692258 | 6/1953 | United Kingdom . |
| 738407 | 10/1955 | United Kingdom . |
| 872292 | 7/1961 | United Kingdom . |
| 1071053 | 6/1967 | United Kingdom . |
| 1084716 | 9/1967 | United Kingdom . |
| 1533343 | 11/1978 | United Kingdom . |
| WO91/02117 | 2/1991 | WIPO . |

OTHER PUBLICATIONS

*Chem. Abstr.*, vol. 71, No. 14, Abstract No. 62249n Oct., 1969.

Ball et al., *J. Am. Chem. Soc.*, 78, 1125–1129(1956) (Month Unknown).

*Ullmanns Encykopädie der technischen Chemie*, 4th ed., vol. 17, pp. 694, 721 and 721 (Date Unknown).

*Primary Examiner*—Alan Diamond

*Attorney, Agent, or Firm*—Wenderoth, Lind & Ponack

[57] ABSTRACT

A method for imparting shrink resistance to wool which comprises treating the wool simultaneously with both hydrogen peroxide and permonosulphuric acid or salts thereof. Preferably, the wool is then further subjected to a polymer treatment. The method may be performed either as a continuous process or as a batch process.

12 Claims, No Drawings

METHOD FOR THE TREATMENT OF WOOL

This invention relates to a method for the treatment of wool so as to impart shrink resistance, and which involves treating the wool with both hydrogen peroxide and permonosulphuric acid.

Many ways of rendering wool shrink resistant are known. These typically involve subjecting the wool to an oxidative treatment alone or, more commonly nowadays, followed by a polymer treatment.

Various two-step shrink-proofing processes in which wool is treated first with a chlorinating oxidative agent and subsequently with a pre-formed synthetic polymer have been developed. A wide variety of polymers can be used in aqueous solution or dispersion, including polyamide-epichlorohydrin resins and polyacrylates. A review of work in this field by J. Lewis appears in Wool Science Review, Nay 1978, pages 23–42. British Patent Nos. 1,074,731 and 1,340,859, U.S. Pat. Nos. 2,926,154 and 2,961,347 and European Patent Application No. 0129322A, for example, describe two-step shrink-proofing processes and resins or polymers suitable for use therein.

A number of chlorinating oxidative treatments, or pre-treatments, for use on wool are well known. The source of chlorine may be chlorine gas supplied from cylinders, or chlorinating agents such as hypochlorite and dichloroisocyanuric acid and their salts. For example, British Patent No. 569,730 describes a batch shrink-proofing treatment involving hypochlorite and potassium permanganate; British Patent No. 2,044,310 describes a treatment with an aqueous solution of permanganate and hypochlorite. In all cases the active principle remains the same.

Non-chlorine oxidative treatments, or pre-treatments, for use on wool have been known for some time. Hydrogen peroxide on its own confers a very weak shrink resist effect to wool, but this has never been sufficient to merit its commercial use as a practical anti-shrink treatment. In a treatment known as the Perzyme Process, wool is first bleached with hydrogen peroxide and then treated with a mixture of the enzyme papain and sodium bisulphite. The disadvantages of this process are that the wool suffers a weight loss during the treatment, the handle of the wool deteriorates and the treatment is slow and not so easily applied to wool tops as to yarns and fabrics.

Permonosulphuric acid and its salts have been known for some time to confer reasonable levels of shrink resistance to wool either when used alone, as disclosed in British Patent No. 1,084,716, or in combination with a chlorinating agent, as disclosed in British Patent No. 1,073,441. British Patent No. 738,407 describes a process for the manufacture of permonosulphuric acid from hydrogen peroxide and concentrated sulphuric acid. The product is said to be suitable for use as a bleaching agent and various other purposes. British Patent Nos. 872,292 and 991,163 disclose processes for the shrink-proofing of wool which comprise treating the wool with permonosulphuric acid and a permanganate, or with an aqueous solution of permonosulphuric acid at a temperature in excess of 70° C., respectively. British Patent No. 1,071,053 describes a treatment for imparting shrink resistance to wool which comprises first applying an aqueous solution of permonosulphuric acid, or a salt thereof, and subsequently treating the wool with an aqueous solution of hydrogen peroxide. The teaching is limited to a sequential or two-step treatment and the level of shrink resistance achieved is, by today's standards, very low. British Patent No. 1,118,792 describes a shrink resist treatment which comprises treating the wool with permonosulphuric acid, a permanganate and dichloroisocyanuric acid or trichloroisocyanuric acid and, optionally, also with sulphurous acid or a salt thereof.

Of the above-mentioned non-chlorine treatments, permonosulphuric acid is preferred as it imparts a much higher standard of washability when used alone than does hydrogen peroxide. Peroxide treatments for the purpose of bleaching wool are performed at a pH of from 5.0 to 10.0, typically pH 7.5 to 8.5. Normal bleaching takes anything from 1 to 16 hours depending upon the method employed, the treatment times for the so-called rapid bleaching systems range from 30 minutes to 3 hours. Permonosulphuric acid treatments, are generally carried out over a shorter time and can be applied continuously by passing wool top through the nip of a horizontal pad mangle, whilst maintaining a constant level of permonosulphuric acid treatment liquor in the trough formed by the two pad rollers and two end plates butting against the rollers at either end. In an alternative batch treatment, particularly suited for use in treating garments, permonosulphuric acid is dripped into a liquor bath over a period of 10 to 30 minutes. A further period of time, perhaps 40 to 40 minutes, may be needed before full exhaustion of the permonosulphuric acid occurs.

The level of shrink resistance which can be attained using these non-chlorine treatments alone is, generally speaking, not sufficient to meet the exacting modern standards set for shrink resist performance. It is common practice with chlorine-based pretreatment processes, which do not in themselves generate the full shrink resistance for IWS TM 31 5×5A wash performance, to apply a polymer to the wool to generate a further shrink resist effect capable of meeting the standard. Few polymers are known which will adhere satisfactorily to wool that has been treated with either hydrogen peroxide or permonosulphuric acid alone, and result in wool which fully meets the requirements set today by the International Wool Secretariat (IWS) for machine washability (e.g. the IWS TM31 standard). This is particularly true with regard to treatments on wool top and worsted spun yarn or garments. Furthermore, even those polymers which can be used are often found to cause problems during the subsequent spinning or dyeing operations resulting in partial loss of shrink resistance and general processing difficulties. Only those processes where the application of permonosulphuric acid is accompanied by chlorination (e.g. in the form of hypochlorite or dichloroisocyanurate) are usually able to reach an acceptable standard of shrink resistance.

In order to produce wool with a machine washable (or "Superwash") standard of shrink resist performance, by the continuous processing of wool tops, it has therefore been necessary to subject the wool to an oxidative treatment involving the use of chlorine. In recent years, however, increasing concern has been expressed about the generation of chlorinated residues during Superwash treatments and their damaging effects on the environment. Such residues are coming under closer scrutiny and discharge levels are being set for the amount of absorbable organic halogen (AOX) which can be released from shrink resist processing machinery. It has therefore become desirable, indeed essential, to find some means of reducing the level of AOX discharge from such operations. The present invention seeks to provide a non-chlorine oxidative treatment, or pre-treatment, for rendering wool shrink resistant.

According to the present invention there is provided a method for the treatment of wool so as to impart shrink resistance and which comprises treating the wool simultaneously with both hydrogen peroxide and permonosulphuric acid or salts thereof. Preferably, though not necessarily, the wool is also treated with a polymer.

It has surprisingly been found that treatment of the wool with both hydrogen peroxide and permonosulphuric acid imparts an increased level of shrink resistance. There appears to be a synergistic effect and the degree of shrink resistance achieved is significantly greater than that which would be expected from either treatment alone or from the simple cumulative effect which might be predicted if the two treatments were carried out in succession but otherwise under identical conditions.

Where a suitable polymer is subsequently applied to the wool, it has further been found that this combined treatment enhances the effect created by the polymer. In addition, in cases where it is desired to confine the effective treatment to the surface layer of the fibre, rather than throughout the core of the fibre, electrolyte may be added to the treatment liquor. This addition may be desirable where a level of treatment was employed such that loss of fibre strength may occur if precautions were not taken to reduce the amount of treatment liquor penetrating to the centre of the fibre. Typical electrolytes which may be employed are for example: sodium and potassium sulphates or bisulphates, or other water soluble salts of alkaline or alkaline earth metals. However it must be appreciated that it will generally be undesirable to employ chlorides, due to the tendency to generate chlorine. It will similarly be undesirable to use zinc or other heavy metal salts due to the adverse environmental impact of the effluent from such a process.

The concentration of electrolyte which may be employed can be as high as the limit of solubility of said salt in the treatment liquor. However, in practice concentration lower than this, usually in the range 0.5–200 grammes per liter would be employed.

Although not considered essential to the invention, it may also be found desirable to incorporate small amounts of peroxide catalysts in the pad liquors to enhance the rate of reaction of the liquor with the wool. In such cases it is undesirable to use such high level of catalyst that the pad liquors decompose spontaneously. The amount of catalyst used will be controlled by the catalyst employed. Generally catalysts comprise heavy metal salts such as those of copper, iron, manganese, cobalt/nickel or chromium. It is also possible to use oxidising salts of such heavy metals, for example potassium permanganate. The preferred method of use is to dissolve the catalyst in the solution of permonosulphate which is then only mixed with peroxide immediately prior to introduction to the wool.

With regard to the treatment with both hydrogen peroxide and permonosulphuric acid which characterises the method of this invention, it is possible for this to be performed in several ways. Most preferably, however, the hydrogen peroxide is mixed with the permonosulphuric acid immediately prior to its application to the wool. A vigorous reaction occurs and the wool becomes noticeably warm.

A similar effect is achieved when wool which has already been treated with permonosulphuric acid, and optionally also a polymer, is then treated with hydrogen peroxide in a bleaching operation. However, in this case the desired enhanced shrink resist effect is only generated by a prolonged treatment of 0.5 to 2.0 hours at alkaline pH and does not appear to be so pronounced. This slowness of action renders the approach of post-treatment with peroxide unusable for commercial continuous treatment operations.

The permonosulphuric acid is typically used at levels of from 0.1 to 6.0% by weight on the weight of the dry wool, preferably from 0.5 to 4.5%. The hydrogen peroxide is typically used at levels of 0.005 to 6.0% active peroxide by weight on the weight of the dry wool, most preferably from 0.05 to 2.0%. It will be understood that salts of the peroxide and/or permonosulphuric acid may be present. It will also be understood that substances which are capable of generating hydrogen peroxide upon reaction, such as perborates and peracids, may be used as sources of hydrogen peroxide. It will further be understood that substances which are capable of generating permonosulphuric acid upon reaction, such as a mixture of concentrated sulphuric acid and concentrated hydrogen peroxide, may be used as sources of permonosulphuric acid. In the latter case, known and controlled excesses of hydrogen peroxide would be used and there would need to be provision for cooling and diluting the mixture following the in situ generation of permonosulphuric acid.

Preferably, though not necessarily, the method of the invention includes a polymer treatment of the wool. In principle, any polymer that is capable of adhering or exhausting on to the wool (following a pre-treatment of the aforementioned type) is suitable for use. As indicated above, problems have been encountered when applying polymers to wool that has been treated by either hydrogen peroxide or permonosulphuric acid alone. Having regard to the improved level of shrink resistance achieved by the combined use of hydrogen peroxide and permonosulphuric acid, however, polymer treatments which might otherwise be considered ineffective (when used on wool treated with either hydrogen peroxide or permonosulphuric acid alone), can be used successfully in the method of this invention.

Polymers available for use include those described in European Patent Application Nos. 0129322A, 0260017A and 0315477A, the Hercosett polymers, Basolan SW polymer, silicone polymers and the Dylan Ultrasoft polymers. Mixtures of two or more polymers may be employed, either in pre-mixed form or through separate dosings. One obvious restriction, however, is that the polymer(s) chosen must be suited to the further processing to which the wool will be subjected. As is well known, for example, certain silicones may not be suitable on wool which has to be subsequently spun into yarn because of the undesirable effects that this type of polymer system can have on the spinning operation.

One polymer family which is particularly preferred for use in this invention is described in British Patent Application No. 8916906, corresponding to U.S. application Ser. No. 07/556,976, now allowed and the issue fee having been paid and is represented by one of the following structural formulae:

i)

$$Z\text{-}\{[A]_m\text{-}N(R_1)_n\}_r \qquad \text{(I)}$$

which may be expressed more simply as:

$$J[N(R_1)_n]_r \qquad \text{(II)}$$

or ii) a structure involving crosslinking or bridging of the above groups (I) or (II):

$$\left[\left[(R_1)_nN\text{-}[A]_m\right]_s\text{-}Z\text{-}\left[[A]_mN(R_1)_{n-1}\right]_{r-s}\right]_t\text{-}B \qquad \text{(III)}$$

which may be expressed more simply as:

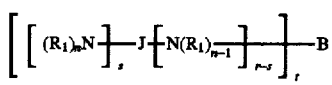

(IV)

or iii) a low molecular weight polymeric structure formed from the above groups (I) or (II):

$$\{K\}_x\text{-}\{B\}_y\text{-}K \quad \text{(V)}$$

wherein

Z represents a residue of a polyol, preferably a di- or trivalent polyol;

A represents a polyalkylene oxide residue, that is a polyether chain produced by polymerisation of, for example, ethylene, propylene or butylene oxides or tetrahydrofuran;

B is the residue created by bi- or polyfunctional reaction between any polyfunctional reactive group and the parent amine of the title compounds (formula (I) where $R_1$ is hydrogen in all cases), and may be taken, for example, to represent a group $$\text{-E-}(R_3)_pN\text{-[D]-}N(R_3)_p\text{-E-} \quad \text{(VI)}$$

a group

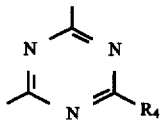

(VII)

a group resulting from the reaction of a bi- or polyfunctional species capable of reacting with amino groups, for example: epihalohydrins, alkyl di- and polyhalides, di- or polycarboxylic acids or their acyl halides and anhydrides, dicyandiamide, urea and formaldehyde, a group derived from low molecular weight reactive resins such as the Bisphenol A type, or a group derived from reaction of a cationic polymeric reactive species such as

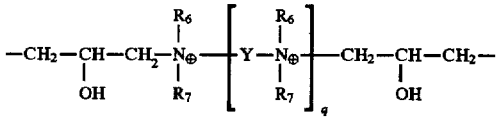

where $R_6$ and $R_7$ are selected from $C_1$–$C_5$ alkyl and $C_2$–$C_5$ hydroxyalkyl radicals, Y is selected from $C_2$–$C_6$alkylene radicals, 2-hydroxy-1,3-propylene radicals, and the radicals:

$$\text{—}CH_2CH_2NHCONHCH_2CH_2\text{—}$$

and $$\text{—}CH_2CH_2CH_2NHCONHCH_2CH_2CH_2\text{—}$$

and q is an integer of from 0 to 20, provided that when q is greater than 2, each of the symbols Y need not necessarily have the same significance;

D represents a straight or branched chain hydrocarbon, polysiloxane or polyalkylene oxide residue, and which may also either bear functional groups or may contain functional groups, such as amino groups, which may in turn either bear one or more groups. $R_1$ or, where B is polyfunctional rather than bifunctional, may represent a further functional reaction point of the group B with the rest of the molecular structure;

E represents a group resulting from the reaction of a bi- or polyfunctional species capable of reacting with amino groups, for example: epihalohydrins, alkyl di- and polyhalides, dicarboxylic acids or their acyl halides and anhydrides, dicyandiamide, urea and formaldehyde;

J represents a residue derived from a polyfunctional polyether;

K represents the monofunctional or polyfunctional residue derived from partial reaction of the basic prepolymers in formulae (I) or (II), i.e. it represents the shaded area in formula (III) as follows:

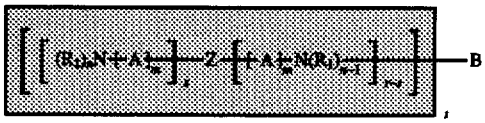

$R_1$ represents a fibre reactive grouping such as the residue derived from monofunctional reaction of an epihalohydrin, an alkyl or alkyl aryl polyhalide or a methylol grouping derived from monofunctional reaction of formaldehyde, or is alkyl, hydroxyalkyl or hydrogen, with the proviso that at least one group $R_1$ per polyoxyalkyleneamine residue, and preferably at least one for each nitrogen, retains residual fibre reactivity;

$R_2$ represents a fibre reactive grouping such as the residue derived from monofunctional reaction of an epihalohydrin, an alkyl or alkyl aryl polyhalide or is a methylol grouping derived from monofunctional reaction of formaldehyde, or alkyl, hydroxyalkyl or hydrogen;

$R_3$ represents hydrogen or $C_1$–$C_4$ alkyl or hydroxyalkyl;

$R_4$ represents halogen or a group

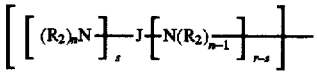

(VIII)

or one of alkylamino, hydroxyalkylamino, alkoxy, alkylarylamino or a group $$\text{-}(R_3)_pN\text{-[D]-}R_5$$

or a functional reaction point of the group B with the rest of the molecular structure, where B is polyfunctional rather than bifunctional;

$R_5$ represents hydrogen or a group $\text{—}N(R_2)_n$ or $\text{—}N(R_3)_n$;

m is between 4 and 50;

n is 2 or 3, with the proviso that, where n is 3, the nitrogen atom involved also bears a formal positive charge;

p is 1 or 2, with the proviso that, where p is 2, the nitrogen atom involved also bears a formal positive charge;

r equals the functionality of group Z;

t is a number representing the functionality of reaction of the residue B;

s is a number between 1 and r−1;

x is between 2 and 30; and y is from $$\frac{x}{t-1}$$

to x, with the general proviso that, in any given instance, the significance of a particular group Z, A, B, R, J or K in any given structure shall not be dictated by the significance of any other such group in the same formula, and further, wherever a formal positive charge is present in the structure, then an appropriate counter anion is taken to be present, for example chloride ion. This type of polymer may be used either alone or in admixture with one or more other polymers.

The application of the polymer to the wool will normally be carried out in the conventional manner from a bath, using the amounts and conditions appropriate for the particular polymer system and which are well known in the art and need not be repeated here in detail. The total amount of polymer solids applied to the wool fibre is generally from 0.005 to 10.0% by weight, most preferably from 0.05 to 2.0%.

It has been found that if the polymer is applied to the wool top in its acidified state, prior to neutralisation of the residual peroxy compounds and/or acidity on the wool, an enhancement of the anti-shrink effect is obtained. This benefit is particularly noted when certain types of polymers, such as silicone polymers, or mixtures of polymers are used. Neutralisation may be performed using aqueous sodium sulphite. It has been found desirable to add a small amount of sodium meta-bisulphite to some polymer baths. This assists in the exhaustion of the polymers concerned on to the wool and enables processing at higher speeds.

Subsequent to the polymer treatment the wool is dried and may then be further processed in the usual manner.

The method of this invention can be performed using conventional equipment, such as the apparatus used in the standard padding technique. For example, the hydrogen peroxide may preferably be mixed with the permonosulphuric acid immediately prior to feeding the liquor to the pad whilst the top is being drawn through the rollers. The apparatus described in British Patent No. 2,044,310 could be utilised.

The method may be operated either as a continuous or as a batch process. While continuous operation will in many circumstances be preferred, it will be appreciated that batch operation at longer liquors enables greater controllability of the reaction with the wool and achieves a more level treatment. The wool for treatment may be in any suitable form from loose wool to finished garments, dyed or undyed, including top, slivers, roving, yarn or carded web, provided of course that suitable mechanical means are available to facilitate handling and treatment of wool in these forms.

It has been found that subjecting wool to treatment with both hydrogen peroxide and permonosulphuric acid, together with a suitable polymer treatment, such as the polymer described in the aforementioned British Patent Application No. 8916906, can produce a shrink resistant wool which is capable of meeting the full requirements of the IWS TM31 standard for machine washable wool. In addition, the resultant wool generally has a whiter appearance than that which is obtainable using chlorinating treatments (chlorination is well known to cause yellowing of the wool). Wool having a soft, natural handle is produced by the method.

With regard to the use of hydrogen peroxide and permonosulphuric acid, the speed of reaction and hence the levelness of the treatment may be controlled using the parameters of pH, dilution and temperature. Turning to the polymer treatment, when present, the polymer (or mixture of polymers) used is chosen so as to cause no problems with mechanical operations such as gilling and spinning and are fully resistant to dyeing. The method has the significant benefit that it may be performed in existing equipment with little or no modification being necessary.

From the environmental viewpoint, the method has the advantage of avoiding the oxidation of wool by chlorine during its operation. This makes it possible to greatly reduce or even eliminate the presence of absorbable organic halogen (AOX) in the effluent which results from the shrink resist treatment of wool and its subsequent dyeing. There will also be no hazard from chlorine gas fumes around the treatment plant and no need (unlike in the case of processes involving gas chlorination) for the bulk storage on site of highly toxic materials.

The present invention will now be illustrated by the following Examples.

EXAMPLE 1

Preparation of Polymer

A 1000 liter vessel equipped with agitator, steam heating coils and condenser was charged with 200 kg of Bis(3-aminopropyl)polytetrahydrofuran (molecular weight 2100), 390 kg of isopropyl alcohol and 168 kg of water. The vessel was sealed, the agitator started to mix the contents and 39 kg of epichlorohydrin was added slowly through a syphon. The reaction mass was heated to reflux (80° C.) and refluxed for four hours. Reaction was judged to be complete when the product dissolved in water to leave minimum residual turbidity.

EXAMPLE 2

Continuous Treatment

Wool top was processed in a backwasher range equipped with horizontal pad mangle, four bowl/squeeze head combinations and a 3 drum rotary dryer. Prior to the trial the backwasher bowls were set using the following:

Bowl 1: 1.25% anhydrous sodium sulphite solution at 25° C. and pH 9.2

Bowl 2: Cold rinse water

Bowl 3: 1% sodium metabisulphite and 3 g/liter of the polymer from Example 1.

Bowl 4: 1 ml/liter softener (Topsoft; PPT).

Two stock solutions were made up as follows:

Solution 1: 120 g/liter commercial potassium permonosulphate (X Salt; PPT) 15 g/liter nonionic wetting agent (Fullwet; PPT) at 28° C.

Solution 2: 32 ml/liter 100 volume (35%) hydrogen peroxide at 31° C.

The two solutions were continuously mixed in equal volumes and promptly fed to the nip of the horizontal pad mangle using the apparatus described in British Patent No. 2,044,310.

A web of eight slivers of wool top (20 g/m 70's quality were fed at a rate of 5 m/minute through the pad mangle onto a scray. The wool became hot to the touch and tests for permonosulphuric acid or hydrogen peroxide were negative. After a short (ca 1 minute) dwell time on the scray, the web of slivers was then passed through the backwasher and into the dryer. During processing, the various backwasher bowls were maintained using a continuous feed as follows:

Bowl 1—feed 100 ml/minute of a 10% solution of anhydrous sodium sulphite (1.5% o.w.w.).

Bowl 2—no feed.

Bowl 3—feed 360 ml/minute of a 10% solution of polymer from Example 1 (1.35% solids o.w.w.).

Bowl 4—no feed (as this was a short trial makeup was deemed unnecessary, otherwise 0.35% o.w.w. of softener would have been fed continuously).

Liquor pickup in the pad was 102% giving a treatment level of 1.93% active permonosulphate ion and 0.655% hydrogen peroxide on weight of wool treated. The dried wool top was then gilled and spun to a count of 2×24s worsted count, knitted into swatches (cover factor 1.29 DT) and tested to IWS TM 31 : 5×5A washes giving an area felting shrinkage of 1.6%. A second swatch was then dyed red using a commercial reactive dye combination and again tested for shrinkage, giving a value of 3.5%.

EXAMPLE 3

A second trial was conducted using the above conditions but omitting the sodium metabisulphite from bowl 3.

Results obtained were (% area felting shrinkage):

| | |
|---|---|
| undyed | 4.0 |
| dyed | 2.5 |

EXAMPLE 4

The process of Example 2 was repeated, but Solution 2 was replaced by water, thus resulting in treatment of the wool by permonosulphate alone. Swatches from Example 4 were washed to IWS TM 31 (3×5A). Results obtained were (% area felting shrinkage):

| | | |
|---|---|---|
| Example 4 | undyed | −15.0 |
| | dyed | −33.9 |

EXAMPLE 5

In order to illustrate the effect of peroxide post-treatment on the performance of permonosulphate treated wool, a series of knitted swatches were prepared using the following treatment after scouring in nonionic detergent.

All swatches were treated with 2% o.w.w. permonosulphate using a 10% solution of potassium permonosulphate at pH 4.0 by dripping this into a bath containing the swatches at a liquor ratio of 30:1, then treating the swatches for 25 minutes until starch iodide paper indicated that the permonosulphuric acid had exhausted onto the wool. The swatches were then treated in a bath containing 1% o.w.w. of anhydrous sodium sulphite for 20 minutes at 20° C. and pH 7.5. One swatch was removed, the others being treated in a fresh bath with 1.5% o.w.w. solids of polymer from Example 1, dripped in as a 10% solution over 10 minutes, the polymer being allowed to exhaust onto the fibre by raising the bath temperature to 40° C. One swatch was retained, the remaining swatches were treated with a 2 volume solution of hydrogen peroxide at pH 8.5, controlled using 2 g/l sodium pyrophosphate for 1 minute, 5 minutes and 30 minutes respectively.

The following shrinkage figures were obtained using IWS TM 31 4×5A washes:

| | | |
|---|---|---|
| Permonosulphate only | 51.4% | (2 × 5A only) |
| Permonosulphate and polymer | 15.0% | |
| 1 minute peroxide | 11.8% | |
| 5 minutes peroxide | 11.8% | |
| 30 minutes peroxide | 9.8% | |

EXAMPLE 6

Example 4 was repeated using a commercial shrink resist treatment range applying 1.82% o.w.w. of permonosulphate and using two bowls for the sulphite treatment. Topsoft was added at the rate of 0.3% o.w.w. to the softener bowl during processing and 1.5% o.w.w. polymer of Example 1 was fed to the polymer bowl.

During the trial, 500 kg were processed at 5.5 meters/minute using 30 slivers of 21 micron wool of 20 g/m sliver density.

Knitted swatches were prepared, one being peroxide bleached for 2 hours using 2 vol hydrogen peroxide at pH 8.2 as per Example 6.

Shrinkage results were as follows (IWS TM 31 3×5A area felting shrinkage).

| | |
|---|---|
| Ecru | 15% |
| Bleached | 3.7% |

EXAMPLE 7

Knitted 2/24s botany swatches were scoured with a nonionic scouring agent. They were then pretreated with PMS (permonosulphuric acid, potassium salt) by a padding technique, as outlined below, in order to determine the effect of adding peroxide, with and without a heavy metal catalyst, on the efficiency of the pretreat. The swatches were subsequently treated with polymer and given (2+2)×5A washing cycles to determine the area felting shrinkage.

Pretreatment: Knitted swatches were immersed in Pretreat solutions listed in Table 1 for 10 seconds then passed through a pad mangle to give an expression of 100%. The swatches were allowed to lay flat for 10 minutes then immersed in a solution containing 40 g/l sodium sulphite (adjusted to pH8 with soda ash) for 10 minutes. The swatches were rinsed thoroughly, hydroextracted then polymer treated, by exhaustion, using 1% solids o.w.w. DP3248 (Precision Processes (Textiles) development product) at pH7. The swatches were then hydroextracted, tumble dried and wash tested.

The results of the wash tests are shown in Table 1, and clearly indicate the beneficial effect of peroxide in this process. A heavy metal catalyst ($KMnO_4$) does not appear to have much effect, except when present in excess (Pretreat solution 4), when it causes very rapid decomposition of the peroxide, effectively removing it from the solution.

TABLE 1

| Pretreat Solution Composition (in 1000 ml) | 7A | 2 × 5A | 4 × 5A |
|---|---|---|---|
| 60 g PMS/pH 5/1 g Fullwet | +6.0 | −13.2 | −27.1 |
| | +1.8 | −9.9 | −23.3 |
| 60 g PMS/pH 5/32 ml $H_2O_2$/1 g Fullwet | +6.0 | −13.2 | −27.1 |
| | +1.8 | −9.9 | −23.3 |
| 60 g PMS/pH 2.4/32 ml $H_2O_2$/1 g Fullwet | +3.7 | +3.2 | +3.1 |

TABLE 1-continued

| Pretreat Solution Composition (in 1000 ml) | 7A | 2 × 5A | 4 × 5A |
|---|---|---|---|
| | +2.5 | +4.1 | −1.2 |
| 60 g PMS/pH 5/32 ml $H_2O_2$/1 g $KMnO_4$/ | +1.9 | −12.5 | −28.4 |
| 1 g Fullwet | +2.3 | −14.4 | −30.5 |
| 60 g PMS/pH 5/32 ml $H_2O_2$/0.1 g $KMnO_4$/ | −4.0 | +1.4 | −4.1 |
| 1 g Fullwet | −4.9 | +3.2 | +2.7 |
| 60 g PMS/pH 5/32 ml $H_2O_2$/0.01 g $KMnO_4$/ | −5.2 | +2.7 | −3.8 |
| 1 g Fullwet | −4.6 | −2.6 | −5.6 |

Note: a +ve value indicates an extension.

We claim:

1. A method for the treatment of wool so as to impart shrink resistance, wherein the treated wool meets the requirements for test IWS TM31 standard, consisting of contacting the wool simultaneously with both hydrogen peroxide and permonosulphuric acid or salts of permonosulphuric acid, said method being performed on wool which has not been subjected to pretreatment with chlorine or chlorine generating agents, optionally in the presence of a heavy metal peroxide catalyst and optionally in the presence of an electrolyte salt and optionally applying to said wool one or more polymers.

2. The method as claimed in claim 1, which further comprises applying to the wool one or more polymers.

3. The method as claimed in claim 2, wherein there is applied a mixture of two or more polymers.

4. The method as claimed in claim 2, wherein the total amount of polymer solids applied to the wool is from 0.05% to 2.0% by weight.

5. The method as claimed in claim 2, wherein any residual peroxy groups and/or acidity on the wool is neutralized, and the polymer is applied prior to the neutralization of the residual peroxy compounds and/or acidity on the wool.

6. The method as claimed in claim 1, wherein the hydrogen peroxide and the permonosulphuric acid are mixed together immediately prior to being applied to the wool.

7. The method as claimed in claim 1, wherein the hydrogen peroxide is used at a level of from 0.005 to 2.0% active peroxide by weight based on the weight of the dry wool.

8. The method as claimed in claim 1, wherein the permonosulphuric acid is used at a level of from 0.1 to 6.0% by weight based on the weight of the dry wool.

9. The method as claimed in claim 1, wherein the treatment is carried out in the presence of an electrolyte salt at a concentration of from 0.5–200 g per liter.

10. The method as claimed in claim 1, wherein the treatment is carried out in the presence of a heavy metal peroxide catalyst.

11. The method as claimed in claim 1 wherein said treatment is carried out as a continuous treatment.

12. The method as claimed in claim 1 wherein said treatment is carried out as a batch treatment.

* * * * *